US005141716A

United States Patent [19]

Muccitelli et al.

[11] Patent Number: 5,141,716

[45] Date of Patent: Aug. 25, 1992

[54] METHOD FOR MITIGATION OF CAUSTIC CORROSION IN COORDINATED PHOSPHATE/PH TREATMENT PROGRAMS FOR BOILERS

[75] Inventors: John A. Muccitelli, Feasterville; Nancy Feldman, Trevose, both of Pa.

[73] Assignee: Betz Laboratories, Inc., Trevose, Pa.

[21] Appl. No.: 643,889

[22] Filed: Jan. 18, 1991

Related U.S. Application Data

[62] Division of Ser. No. 427,287, Oct. 25, 1989, Pat. No. 5,019,342.

[51] Int. Cl.[5] ..... C23F 11/06

[52] U.S. Cl. ..... 422/16; 210/696; 210/698; 252/390; 252/392; 252/394; 252/401; 252/403; 252/405; 422/12; 422/14

[58] Field of Search ..... 422/12, 14, 16; 252/390, 392, 394, 401, 403, 405; 210/696, 698

[56] References Cited

U.S. PATENT DOCUMENTS

| | | | |
|---|---|---|---|
| 4,253,886 | 3/1981 | Aonuma et al. | 422/9 |
| 4,372,873 | 2/1983 | Nieh | 422/12 |
| 4,557,838 | 12/1985 | Nichols et al. | 422/12 |
| 4,877,578 | 10/1989 | Zetlmeisl et al. | 422/16 |

FOREIGN PATENT DOCUMENTS 0018083 10/1980 European Pat. Off. .

OTHER PUBLICATIONS

CA79(4):22372f, Antropov et al., 1973.

Power Engineering, Feb. 1978, George Gibson, pp. 66-69, "The Basics of Phosphate-pH Boiler Water Treatment".

*Primary Examiner*—Robert J. Warden

*Assistant Examiner*—Timothy M. McMahon

*Attorney, Agent, or Firm*—Alexander D. Ricci; Philip H. Von Neida

[57] ABSTRACT

The present invention utilizes low volatility amines or alkanol amines to control caustic corrosion which can take place when a boiler system, treated with a coordinated phosphate/pH program, is "out of control".

N-substituted hydroxyalkyl piperazines are also capable of mitigating caustic corrosion in coordinated phosphate/pH programs. Combinations of the compounds of the present invention and phosphate have also been shown to be efficacious at mitigating caustic corrosion in coordinated phosphate/pH programs.

12 Claims, 2 Drawing Sheets

METHOD FOR MITIGATION OF CAUSTIC CORROSION IN COORDINATED PHOSPHATE/PH TREATMENT PROGRAMS FOR BOILERS

This is a divisional of application Ser. No. 07/427,287, filed Oct. 25, 1989, now U.S. Pat. No. 5,019,342.

BACKGROUND OF THE INVENTION

Boilers using demineralized or evaporated makeup water or pure condensate are known to be prone to caustic attack. High pressure boilers are particularly susceptible to this type of metal corrosion.

The inside surfaces of the boiler are typically protected with magnetite. Hydroxide ion, being the predominant anion in high purity boiler water, can dissolve the magnetite when highly concentrated. Even though high purity water is being used, caustic (NaOH) can nonetheless become highly concentrated, primarily due to the presence of iron oxide deposits on radiant wall tubes. While the bulk water may contain only 5–10 ppm of caustic, it is quite possible to have localized caustic concentrations of up to 100,000 ppm. The iron oxide deposits are generally porous so that the water is drawn into the porous deposit. Due to heat being applied from beneath, steam is generated and passes out of the porous deposit, while fresh water is again drawn into the porous deposit. The result is the noted high concentration of caustic which must be dealt with if the boiler is to be properly protected.

A widely used method for controlling caustic corrosion in boilers using demineralized (high purity) makeup water, particularly in high pressure boilers, is the coordinated phosphate/pH control treatment. This method of treatment is detailed in an article by George Gibson entitled "The Basics of Phosphate-pH Boiler Water Treatment", *Power Engineering*, Feb., 1978, page 66, which article is incorporated herein by reference to the extent necessary to complete this disclosure. In any event, portions are excerpted below for purposes of explanation.

The coordinated phosphate/pH corrosion control treatment is based on two principles:

First, that sodium phosphates are a pH buffer; and second, that disodium hydrogen phosphate converts potentially corrosive caustic into relatively harmless trisodium phosphate according to equation 1 below:

$$\underset{\text{disodium hydrogen phosphate}}{Na_2HPO_4} + \underset{\text{caustic}}{NaOH} \rightleftharpoons Na_3PO_4 + H_2O$$

Accordingly, general corrosion is prevented through the control of boiler water pH. Adherent deposits with concomitant caustic corrosion are prevented by maintaining a disodium phosphate residual in the boiler water to react with caustic according to Equation 1 above.

Figure 1:
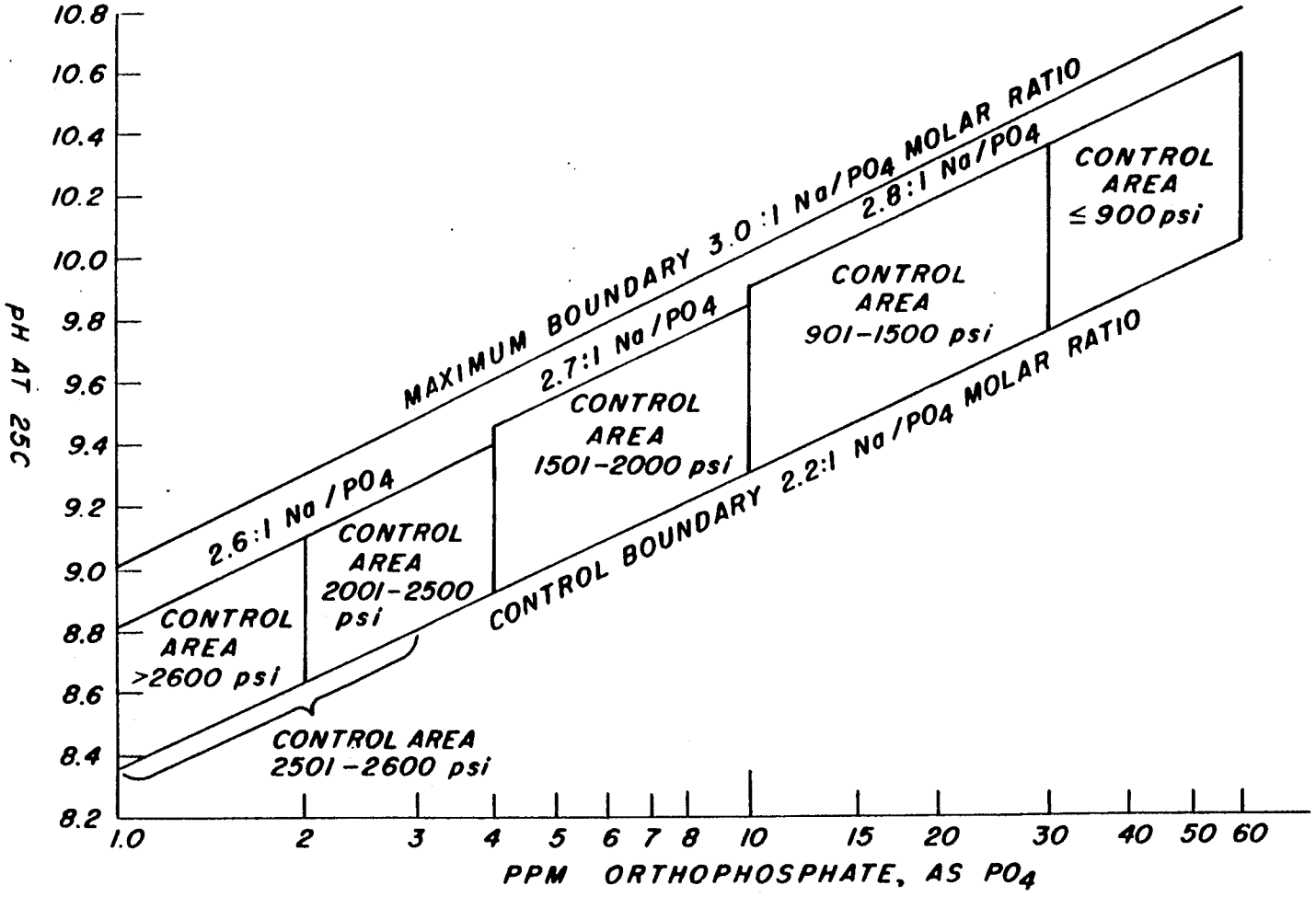
FIG. 1 shows a coordinated pH/phosphate control scheme.

In the program is implemented with a control chart such as shown in FIG. 1. Disodium hydrogen phosphate is present if the coordinate of pH and phosphate lies within the control boundary.

Many sodium phosphates are used in boiler water treatment. Of these, orthophosphates are preferred. Complex phosphates, in the form of polymer chains, breakdown into orthophosphates at boiler water temperatures by a process known as reversion. The orthophosphates are monosodium dihydrogen phosphate (MSP), disodium hydrogen phosphate (DSP) and trisodium phosphate (TSP).

Orthophosphates can be identified by name, formula, or sodium-to-phosphate molar ratio which can be expressed with the notation $Na:PO_4$.

Monosodium dihydrogen phosphate has one mole of sodium per mole of phosphate. Therefore, the sodium-to-phosphate ratio is 1 to 1 ($Na:PO_4=1:1$). Disodium hydrogen phosphate, with two moles of sodium per mole of phosphate has a $Na:PO_4=2:1$, and trisodium phosphate has a $Na:PO_4=3:1$.

Sodium to phosphate molar ratios are useful to describe mixtures of phosphates in solution. For example, solutions of mixtures of DSP and TSP have a $Na:PO_4$ between 2:1 and 3:1. The $Na:PO_4$ is fairly proportional to the mix ratio. For instance, a solution of half DSP and half TSP has $Na:PO_4$ molar ratio of about 2.5:1 (it is actually 2.46:1 because DSP and TSP have different molecular weights).

Figure 2:
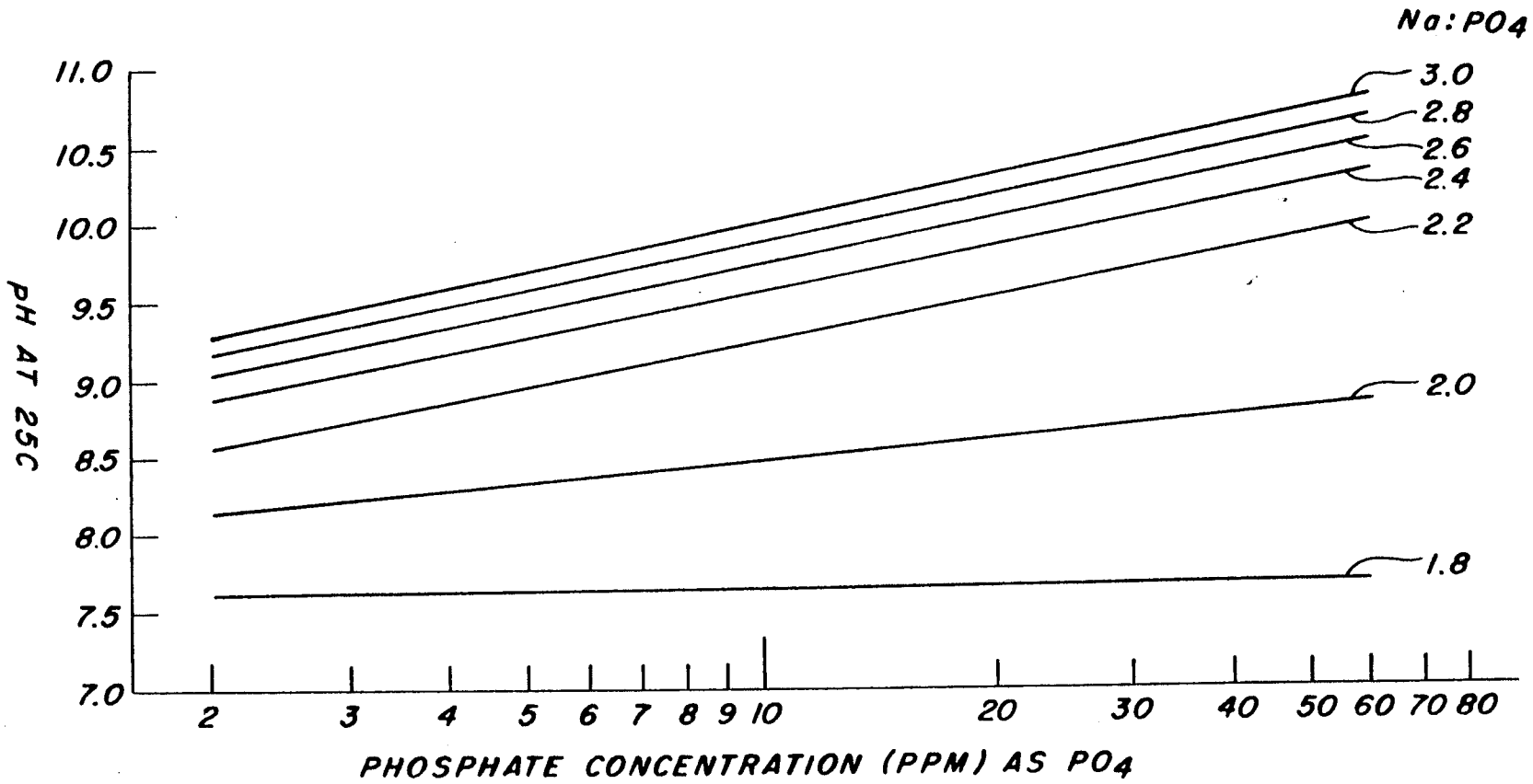
FIG. 2 shows pH increases with operating conditions

As shown in FIG. 2, the pH increases with increasing an $Na:PO_4$ molar ratio (at equal phosphate concentrations). Accordingly, the solution pH and phosphate concentration identify the phosphate form, it being kept in mind that disodium hydrogen phosphate is the species which neutralizes caustic according to Equation 1.

A trisodium phosphate solution exists if the phosphate/pH coordinate falls on the $Na:PO_4=3:1$ line; a disodium hydrogen phosphate solution exists if the coordinate falls on the $Na:PO_4=2:1$ line; and a mixture of DSP and TSP exists if the coordinate falls between the 2:1 and the 3:1 lines. As the coordinate approaches the 3:1 line, there is more and more TSP and less and less DSP in the solution.

The solution is a mixture of TSP and caustic if the coordinate falls above the 3:1 line. In this "free caustic" region there is no DSP to tie up the caustic and caustic corrosion can occur.

In order for a coordinated phosphate/pH program to be successful, it is necessary to insure that a sufficient quantity of DSP is maintained to neutralize excess caustic. This is accomplished by monitoring the pH and phosphate level and using a control chart as shown in FIG. 1. If the coordinate of pH and phosphate lies within the control boundary, sufficient DSP is present.

There has been some confusion in applying sodium to phosphate ratios. The $Na:PO_4$ used in phosphate/pH control is determined only from boiler water pH and phosphate concentration, not by measuring sodium and phosphate concentrations of the boiler water.

Problems can be encountered in controlling these programs due to the phenomenon known as "phosphate hideout" which occurs when elevated temperatures at the tube wall or beneath deposits induce precipitation because of retrograde solubility of certain salts. Hideout is usually observed when boiler load suddenly increases. The increase in boiler load is accompanied by a decrease in phosphate levels in the blowdown. When the load decreases, the phosphate level rises. This will be reflected on the control chart by showing that the system parameters lie outside the control boundaries. If precipitation increases the $Na:PO_4$ above 3:1, caustic corrosion is possible.

Caustic corrosion requires high caustic concentrations which are not usually present in bulk boiler water, but may be found in areas where boiler water concentrates. This often occurs in porous iron deposits when water diffuses into the deposit, becomes trapped and boils. Boiling produces relatively pure steam which diffuses out of the deposit and leaves a concentrated caustic residue behind. Caustic leakages will also cause a system being treated with a coordinated phosphate/pH program to be "out of control". In order to bring the system back in control, the system must be blown down and/or additional phosphate must be added.

When a system treated with a coordinated phosphate/pH program is "out of control", caustic corrosion can occur. An object of this invention is to mitigate corrosion in a system during "out of control" periods. As used herein, the term "out of control" means that the system parameters, viz., phosphate concentrations, sodium-to-phosphate ratios, and pH lie outside the control boundaries of a control chart similar to FIG. 1.

While the coordinated phosphate/pH corrosion control treatment is widely used, it is not without its drawbacks or limitations. Often, it is desirable to supplement the treatment with additional corrosion inhibitor; however, this is not always practicable. It has been customary for many years to use the sodium salt of a polymeric dispersant, such as sodium polymethacrylate, as the supplement. When the sodium salt form is used, the $Na:PO_4$ in the boiler water is often significantly altered and the solids level of the boiler water rises. If the $Na:PO_4$ is allowed to rise over the 3:1 line of FIG. 1, caustic attack again becomes a problem, and, particularly in high pressure boiler systems, increased solids levels can lead to undesirable filming in the water. Thus, the use of supplemental treatment has been severely limited. In fact, when the $Na:PO_4$ is near the control limit, the supplemental treatment has, on occasion, been completely omitted.

European Patent 0,018,083, published Feb. 2, 1985, discloses the use, in conjunction with a coordinated phosphate/pH corrosion control treatment, of an aqueous solution of an organic acid dispersant which has been neutralized with a suitable amine (or $NH_3$) which is volatile under the conditions of the boiler water to be treated and has a basicity constant of 8.0 or less. The patent teaches the use of morpholine as a suitable amine for the purpose of neutralizing the organic acid dispersant.

SUMMARY OF THE INVENTION

The present invention relates to the use of low volatility amines, alkanolamines, or hydroxyalkyl substituted piperazine to control caustic corrosion which can take place when a boiler system which is being treated with a coordinated phosphate/pH program. As used herein, the term "out of control" means that the system parameters, viz., phosphate concentrations, sodium-to-phosphate ratios, and pH, lie outside the control boundaries of a control chart similar to FIG. 1.

Exemplary compounds of the present invention include diethanolamine (DEA) and 1-(2-hydroxyethyl) piperazine (HEP).

DETAILED DESCRIPTION OF THE INVENTION

The present invention utilizes low volatility amines or alkanolamines (e.g., diethanolamine) to control caustic corrosion which can take place when a boiler system being treated with a coordinated phosphate/pH program is "out of control". Other compounds utilized in this invention are N-substituted hydroxyalkyl piperazines, such as HEP.

Representative low volatility alkanolamine compounds include the homologs wherein the nitrogen is either mono, di, or tri-substituted to form the following compounds:

ethanolamine,
1-propanolamine,
isopropanolamine,
3-propanolamine,
1-butanolamine,
2-butanolamine,
3-butanolamine,
4-butanolamine,
iso-butanolamine,
sec-butanolamine, and
tert-butanolamine.

Preferably, the low volatility alkanolamine is selected from the group consisting of monoethanolamine, diethanolamine, triethanolamine, monoisopropanolamine, diisopropanolamine, triisopropanolamine, mono-3-propanolamine, di-3-propanolamine, and tri-3-propanolamine. Most preferably, the low volatility alkanolamine is selected from the group consisting of diethanolamine, diisopropanolamine, and di-3-propanolamine.

Representative N-substituted hydroxyalkyl piperazines include the following:

1-(1-hydroxyethyl)piperazine,
1-(2-hydroxyethyl)piperazine,
1-(1-hydroxypropyl)piperazine,
1-(2-hydroxypropyl)piperazine,
1-(3-hydroxypropyl)piperazine,
1,4-bis(1-hydroxyethyl)piperazine,
1,4-bis(2-hydroxyethyl)piperazine,
1,4-bis(1-hydroxypropyl)piperazine,
1,4-bis(2-hydroxypropyl)piperazine, and
1,4-bis(3-hydroxypropyl)piperazine.

Preferably the N-substituted hydroxyalkyl piperazine is selected from the group consisting of 1-(1-hydroxyethyl) piperazine and 1-(2-hydroxyethyl) piperazine.

The amount of compound added to the boiler water, either directly or via feedwater, could vary over a wide range and would depend on such known factors as the nature and severity of the problem being treated. It is believed that the minimal amount of the alkanolamine or hydroxyalkyl piperazine, based on the mole ratio of orthophosphate present in the boiler water, could be 0.2 moles of compound per mole of phosphate. The preferred minimum is about 3.5 moles of compound per mole of phosphate. It is believed that the maximum amount of the alkanolamine or hydroxyalkyl piperazine, based on the mole ratio of orthophosphate present in the boiler water, could be as high as 150 moles of compound per mole of phosphate, with the preferred maximum being about 20 moles of compound per mole of phosphate present. The preferred alkanolamine compound for usage is diethanolamine and the preferred hydroxyalkyl piperazine compound is HEP.

EXAMPLES

Experiments were performed in which caustic corrosion was induced on magnetite-coated mild steel coupons under conditions of "dry-out". "Dry-out" is the extreme limit of the concentrating film corresponding to a point where, although there is still a relatively high degree of heat transfer, all of the water in the deposits on the tube surface has evaporated and is not replaced by circulating boiler water. Various treatments were then tested to determine their effect, if any, on corrosion caused by the presence of high levels of sodium hydroxide. A magnetite coating was formed by placing mild steel coupons, each weighing about 10 grams, in a pressure vessel with nitrogen sparged demineralized water, which contained an oxygen scavenger, and heating the vessel to about 179°-286° C. corresponding to a saturation pressure for pure water of about 1000 psig, for 48 hours. The coupons were then cleaned with a pumice/TSP mixture to remove excess loosely-held magnetite. The coupons were then rinsed with deionized water and isopropanol, dried in an oven and cooled in a dessicator. Treatment solutions which contained 10,000 ppm sodium hydroxide, an oxygen scavenger, and the desired treatment, were prepared with nitrogen sparged deionized water. The coupons were placed on a metal surface which was maintained at about 179°-300° C. (which corresponds to a saturation pressure for pure water of about 1250 psig). The treatment solutions were placed on the coupons and the water in the solutions was allowed to boil away. The coupons were then cleaned as described above. The coupons were weighed before application of the solution and again after they were cleaned. Weight loss measurements were used to gauge the amount of corrosion which occurred.

TABLE I

CAUSTIC CORROSION STUDIES
AVERAGE WEIGHT LOSS FOR EACH TREATMENT

| SOLUTION | AVERAGE WEIGHT LOSS (mg)* |
|---|---|
| CONTROL-No NaOH | 0.2 ± 0.1 |
| CONTROL-NaOH | 4.7 ± 0.4 |
| $Na:PO_4$ = 2.5 | −0.3 ± 0.2 |
| $Na:PO_4$ = 3.5 | −0.2 ± 0.3 |
| $Na:PO_4$ = 6.0 | 1.0 ± 0.1 |
| $Na:PO_4$ = 11.0 | 1.8 ± 0.3 |
| Na:DEA = 0.33 | 0.9 ± 0.1 |
| Na:DEA = 0.5 | 0.8 ± 0.2 |
| Na:DEA = 1.0 | 0.6 ± 0.3 |
| Na:DEA = 2.0 | 0.5 ± 0.3 |
| Na:MORPH = 0.33 | 2.6 ± 0.4 |
| Na:MORPH = 0.5 | 2.6 ± 0.3 |
| Na:MORPH = 1.0 | 2.5 ± 0.3 |
| Na:MORPH = 2.0 | 2.5 ± 0.3 |
| $Na:PO_4$ = 11.0 AND Na/DEA = 0.5 | 0.7 ± 0.3 |
| $Na:PO_4$ = 11.0 AND Na/MORPH = 0.5 | 1.6 ± 0.4 |

DEA = Diethanolamine
MORPH = Morpholine
*This value represents an average from nine tests.

TABLE II

CAUSTIC CORROSION STUDIES
AVERAGE WEIGHT LOSS FOR EACH TREATMENT

| SOLUTION | AVERAGE WEIGHT LOSS (mg)* |
|---|---|
| CONTROL-No NaOH | 0.3 +/− 0.1 |
| Na:HEP = 0.33 | 0.4 +/− 0.5 |
| Na:HEP = 0.5 | 1.4 +/− 0.4 |
| Na:HEP = 1.0 | 1.5 +/− 0.3 |
| Na:HEP = 2.0 | 2.8 +/− 0.4 |

TABLE II-continued

CAUSTIC CORROSION STUDIES
AVERAGE WEIGHT LOSS FOR EACH TREATMENT

| SOLUTION | AVERAGE WEIGHT LOSS (mg)* |
|---|---|
| $Na:PO_4$ = 11.0 and Na:HEP = 0.5 | 0.5 +/− 0.2 |

HEP = 1-(2-Hydroxyethyl) piperazine
*This value represents an average from three tests.

As the results presented in Table I illustrate, phosphate proves to be an effective treatment at $Na:PO_4$ rations which would be in, or near, the control boundaries of a coordinated phosphate/pH program. However, as the phosphate $Na:PO_4$ ratio was increased, the corrosion became more severe. The average weight loss increased when the $Na:PO_4$ ratio was 6 and 11 respectively.

Diethanolamine, a low volatility amine, and morpholine, were tested as shown in Table I. Diethanolamine was found to be an effective treatment. While morpholine was observed to decrease corrosion, it was not as efficacious as diethanolamine or phosphate.

It was discovered that when diethanolamine was used in conjunction with phosphate, at $Na:PO_4$ ratios which result in incongruent precipitation, the degree of caustic corrosion was significantly reduced. When combinations of morpholine/phosphate were tested, it was found that the addition of morpholine had little or no effect.

The results presented in Table II indicate that, in addition to diethanolamine, 1-(2-hydroxyethyl) piperazine is capable of mitigating caustic corrosion in coordinated phosphate/pH programs. When combinations of HEP and phosphate were tested it was found that the degree of caustic corrosion was significantly reduced.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. A method for controlling caustic corrosion in a boiler system comprising adding an N-substituted hydroxyalkyl piperazine selected from the group consisting of:

1-(1-hydroxyethyl)piperazine,
1-(2-hydroxyethyl)piperazine,
1-(1-hydroxypropyl)piperazine,
1-(2-hydroxypropyl)piperazine,
1-(3-hydroxypropyl)piperazine,
1,4-bis(1-hydroxyethyl)piperazine,
1,4-bis(2-hydroxyethyl)piperazine,
1,4-bis(1-hydroxypropyl)piperazine,
1,4-bis(2-hydroxypropyl)piperazine, and
1,4-bis(3-hydroxypropyl)piperazine;

to a boiler system treated with a coordinated phosphate/pH program.

2. A method as recited in claim 1 wherein said N-substituted hydroxyalkyl piperazine is selected from the group consisting of 1-(1-hydroxyethyl) piperazine and 1-(2-hydroxyethyl) piperazine.

3. A method as recited in claim 2 wherein said N-substituted hydroxyalkylpiperazine is 1-(2-hydroxyethyl) piperazine.

4. A method as recited in claim 1 wherein from about 0.2 moles to about 150 moles of said N-substituted hydroxyalkyl piperazine per mole of phosphate is added to said boiler system.

5. A method as recited in claim 4 wherein from about 1.75 moles to about 35 moles of said N-substituted hydroxyalkyl piperazine per mole of phosphate is added to said boiler system.

6. A method as recited in claim 5 wherein from about 3.5 moles to about 20 moles of said N-substituted hydroxyalkyl piperazine per mole of phosphate is added to said boiler system.

7. A method for controlling caustic corrosion in a boiler system comprising adding to said boiler system an N-substituted hydroxyalkyl piperazine selected from the group consisting of:

1-(1-hydroxyethyl)piperazine,
1-(2-hydroxyethyl)piperazine,
1-(1-hydroxypropyl)piperazine,
1-(2-hydroxypropyl)piperazine,
1-(3-hydroxypropyl)piperazine,
1,4-bis(1-hydroxyethyl)piperazine,
1,4-bis(2-hydroxyethyl)piperazine,
1,4-bis(1-hydroxypropyl)piperazine,
1,4-bis(2-hydroxypropyl)piperazine, and
1,4-bis(3-hydroxypropyl)piperazine;

in conjunction with phosphate at a $Na:PO_4$ ratio which results in incongruent precipitation.

8. A method as recited in claim 7 wherein said N-substituted hydroxyalkyl piperazine is selected from the group consisting of 1-(1-hydroxyethyl) piperazine and 1-(2-hydroxyethyl) piperazine.

9. A method as recited in claim 8 wherein said N-substituted hydroxyalkyl piperazine is 1-(2-hydroxyethyl) piperazine.

10. A method as recited in claim 7 wherein from about 0.2 moles to about 150 moles of said N-substituted hydroxyalkyl piperazine per mole of phosphate is added to said boiler system.

11. A method as recited in claim 10 wherein from about 1.75 moles to about 35 moles of said N-substituted hydroxyalkyl piperazine per mole of phosphate is added to said boiler.

12. A method as recited in claim 11 wherein from about 3:5 moles to about 20 moles of said N-substituted hydroxyalkyl piperazine per mole of phosphate to said boiler system.

* * * * *